US008696946B2

(12) United States Patent
Matsumoto et al.

(10) Patent No.: US 8,696,946 B2
(45) Date of Patent: Apr. 15, 2014

(54) CONDUCTIVE POWDER, CONDUCTIVE MATERIAL CONTAINING THE SAME, AND METHOD FOR PRODUCING THE SAME

(75) Inventors: Chihiro Matsumoto, Tokyo (JP); Masaaki Oyamada, Tokyo (JP)

(73) Assignee: Nippon Chemical Industrial Co., Ltd., Tokyo (JP)

( * ) Notice: Subject to any disclaimer, the term of this patent is extended or adjusted under 35 U.S.C. 154(b) by 0 days.

(21) Appl. No.: 13/988,510

(22) PCT Filed: Nov. 21, 2011

(86) PCT No.: PCT/JP2011/076757

§ 371 (c)(1),
(2), (4) Date: May 21, 2013

(87) PCT Pub. No.: WO2012/070515

PCT Pub. Date: May 31, 2012

(65) Prior Publication Data

US 2013/0256606 A1 Oct. 3, 2013

(30) Foreign Application Priority Data

Nov. 22, 2010 (JP) ..... 2010-259763

(51) Int. Cl.

| | |
|---|---|
| ***H01B 1/02*** | (2006.01) |
| ***H01B 1/22*** | (2006.01) |
| ***H01B 5/00*** | (2006.01) |
| ***H01R 11/01*** | (2006.01) |

(52) U.S. Cl.
USPC ..... 252/512; 252/513; 428/403

(58) Field of Classification Search
CPC ..... H01B 1/02; H01B 1/22; B32B 5/16; B32B 5/30; B32B 15/01; C09K 3/1445; C23C 18/08; C23C 30/00; C22B 23/00; C09C 3/066
USPC ..... 252/512–514; 428/403, 404; 419/23; 423/140
See application file for complete search history.

(56) References Cited

U.S. PATENT DOCUMENTS 4,788,080 A * 11/1988 Hojo et al. ..... 427/204
6,312,622 B1 * 11/2001 Toshima et al. ..... 252/513

(Continued)

FOREIGN PATENT DOCUMENTS

JP 61-064882 4/1986
JP 2000-243132 9/2000

(Continued)

OTHER PUBLICATIONS

"International Search Report (Form PCT/ISA/210)", published on Jan. 24, 2012, with English translation thereof, pp. 1-4.

*Primary Examiner* — Mark Kopec
(74) *Attorney, Agent, or Firm* — Jianq Chyun IP Office

(57) ABSTRACT

A conductive powder improving various performances as compared to conventional conductive powders is described. The conductive power includes conductive particles, each of which have a metal or alloy film formed on the surface of a core particle. The conductive particle has thereon protrusions protruding from the surface of the film. Each protrusion includes a particle chain including particles of the metal or alloy linked in a row. It is preferred that the metal or alloy is nickel or a nickel alloy. It is also preferred that the ratio of the total area of the exposed portions of the film to the projection area of the conductive particle is 60% or less.

8 Claims, 2 Drawing Sheets

(56) References Cited

U.S. PATENT DOCUMENTS

| | | | | |
|---|---|---|---|---|
| 6,770,369 | B1 * | 8/2004 | Oyamada et al. | 428/403 |
| 6,923,924 | B2 * | 8/2005 | Sano et al. | 252/512 |
| 7,470,416 | B2 * | 12/2008 | Ishida | 423/403 |
| 8,231,808 | B2 * | 7/2012 | Yang et al. | 252/500 |

FOREIGN PATENT DOCUMENTS

| | | |
|---|---|---|
| JP | 2006-228474 | 8/2006 |
| JP | 2006-302716 | 11/2006 |
| JP | 2010-118334 | 5/2010 |

* cited by examiner

Example 1

Comparative Example 1

CONDUCTIVE POWDER, CONDUCTIVE MATERIAL CONTAINING THE SAME, AND METHOD FOR PRODUCING THE SAME

CROSS-REFERENCE TO RELATED APPLICATION

This application is a 371 application of an international PCT application Ser. No. PCT/JP2011/076757, filed on Nov. 21, 2011, which claims the priority benefit of Japan application no. 2010-259763, filed on Nov. 22, 2010. The entirety of each of the above-mentioned patent applications is hereby incorporated by reference herein and made a part of this specification.

BACKGROUND OF THE INVENTION

1. Field of Invention

This invention relates to a conductive powder and a conductive material containing the same, and also relates to a method for producing a conductive powder.

2. Description of Related Art

The applicant had proposed a conductive powder for electroless plating that has protrusions of nickel or a nickel alloy on its surface (see Patent Document 1). The plating powder exhibits good conductivity due to the effects of the fine protrusions.

In addition to the technique, Patent Document 2 proposed a conductive particle having protrusions, which is obtained by adhering a nickel core material with a particle size of 50 nm to the surface of a core particle with a particle size of 4 μm and then conducting electroless plating of nickel. However, in the conductive particle obtained with this method, the adhesion between the core particle and the nickel core material is weak, and integrity is absent between the nickel film coated on the surface of the core particle and the protrusions. Hence, the protrusions are easily damaged when a pressure is applied to the conductive particle.

Another technique relating to conductive particles with protrusions is described in Patent Document 3. The conductive particle described in this document includes a base particle, and a Ni-containing conductive film that is formed on the surface of the base particle and has, on its surface, protrusions composed of aggregations of massive fine particles.

The applicant has further proposed a conductive powder that improves various performances as compared to the above conventional conductive powders (see Patent Document 4). The protrusions on the conductive particles in the conductive powder have a more slender shape as compared to the protrusions ever known before.

PRIOR-ART DOCUMENTS

Patent Documents

Patent Document 1: Japan Patent Publication No. 2000-243132 gazette

Patent Document 2: Japan Patent Publication No. 2006-228474 gazette

Patent Document 3: Japan Patent Publication No. 2006-302716 gazette

Patent Document 4: Japan Patent Publication No. 2010-118334 gazette

SUMMARY OF THE INVENTION

Problems to be Solved by the Invention

In recent years, accompanying with further downsizing of electronic machines, the line width or pitch of the electronic circuit becomes increasingly smaller. As a result, the conductive powder used in the conductive adhesive, the anisotropic conductive film or the anisotropic conductive adhesive is required to have high conductivity. Though the conductivity can be raised to a certain extent by using a conductive powder having protrusions with any of the above shapes, a particle having even higher conductivity is required because the requirement of improving conductivity becomes increasingly higher.

Accordingly, this invention provides a conductive powder that improves various performances as compared to the above conventional conductive powders.

Means for Solving the Problems

This invention provides a conductive powder that includes conductive particles with each including a core particle and a film of a metal or alloy formed on the surface of the core particle and having a plurality of protrusions protruding from the surface of the film. Each protrusion includes a particle chain that comprises a plurality of particles of the metal or alloy linked in a row.

Moreover, this invention provides, as a preferred method for producing the above conductive powder, a method for producing a conductive powder, which comprises:

a process A of mixing an electroless plating solution containing nickel ion and a hypophosphorate salt with core particles carrying a noble metal to prepare a slurry containing the core particles with an initial nickel film formed on their surfaces, wherein the concentration of nickel ion is adjusted to 0.0085 to 0.34 mole/L, the amount of the hypophosphorate salt is adjusted such that its molar ratio to the amount of nickel ion ranges from 0.01 to 0.5, and the core particles are used in an amount such that the total area thereof based on one liter of the electroless plating solution ranges from 1 $m^2$ to 15 $m^2$; and a process B of simultaneously and continuously adding nickel ion, a hypophosphorate salt and a basic material to the slurry prepared in the process A, so that nickel ion is reduced to form nickel fine-particles in the slurry, and a plurality of protrusions, each of which comprises a particle chain comprising a plurality of the nickel fine-particles linked in a row, is formed on the surface of the initial nickel film on the core particles.

Effect of the Invention

Because the protrusion on the conductive particles constituting the conductive powder is composed of a particle chain of a plurality of particles linked in a row, the conductive powder of this invention has even higher conductivity as compared to the conventional conductive powders.

DESCRIPTION OF EMBODIMENTS

This invention will be further described based on the preferred embodiments. In the conductive powder of this invention, a metal or alloy film (generally called "metal film", hereafter) is formed on the surfaces of the core particles of the constituent conductive particles. The conductive powder of this invention has a feature of having a plurality of protrusions protruding from the surface of the metal film. The protrusion is described below.

The technique of forming numerous protrusions on the surface of a conductive particle is known in this technical field, as described in the "Background" section of this specification. As compared with such prior art, the point that this invention utilizes the protrusions having a specific shape is different from the case of conventional conductive particles. Specifically, the protrusion on the conductive particles constituting the conductive powder of this invention includes a particle chain of a plurality of particles linked in a row. In the following description, the protrusion including a particle chain of a plurality of particles linked in a row is simply called a "linkage protrusion". When the term "protrusion" is used, according to the context, it means a protrusion having a form other than the linkage protrusion in some cases, or means both a linkage protrusion and a protrusion having another form in other cases.

Each particle for constituting the linkage protrusion (called "protrusion-forming particle", hereinafter) is compose of the metal or alloy forming the metal film coated on the core particles. The protrusion-forming particle has a particle size smaller than that of the core particle. The mean particle size of the protrusion-forming particles is preferably 10 to 500 nm and more preferably 20 to 400 nm. When the mean particle size of the protrusion-forming particles is within this range, the feature of linkage protrusions is exhibited. The plurality of protrusion-forming particles constituting one linkage protrusion preferably has about the same particle sizes within the above range, but may include a small number of particles having particle sizes outside of the above range if only the effect of this invention is not adversely affected. The method for measuring the mean particle size of the protrusion-forming particles will be described in details in the examples described later.

Figure 1:
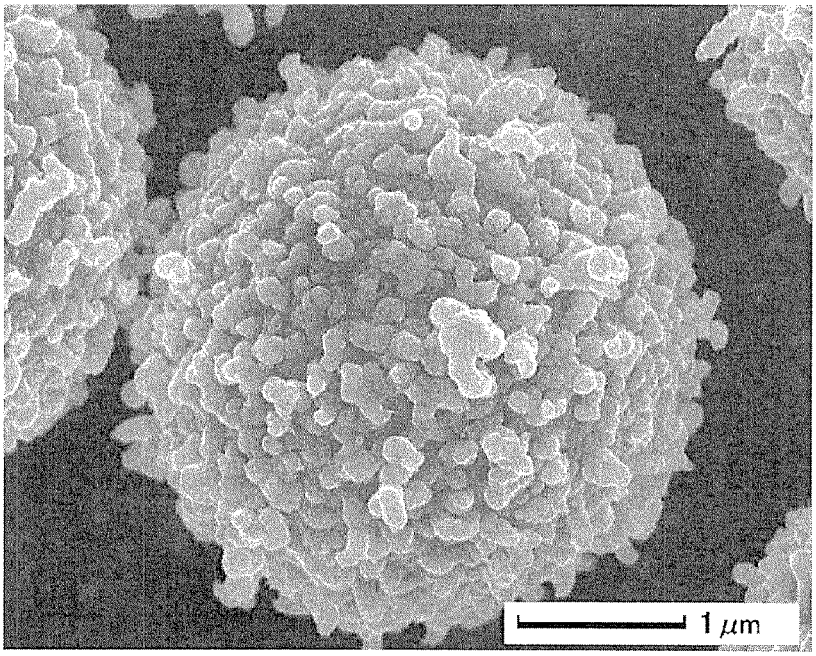
FIG. 1 is a scanning electron microscope (SEM) image of a conductive particle obtained in Example 1.

As shown in FIG. 1 described later, when a linkage protrusion is observed under a scanning electron microscope (SEM), a particle boundary is observed between adjacent protrusion-forming particles. Based on the above observation, the linkage protrusion including a chain of a plurality of protrusion-forming particles is verified. As compared to this, for example, no particle boundary is observed in the protrusions on the conductive particles described in Patent Document 3 mentioned above, wherein one protrusion is considered to be constituted by one slender crystalline particle only.

A plurality of protrusion-forming particles is linked in a row to form a linkage protrusion. The row linkage means that the plurality of protrusion-forming particles is linked while extending in one direction. The linkage protrusion may be constituted by a plurality of protrusion-forming particles linked in a straight line, or by a plurality of protrusion-forming particles linked in a serpent shape. A straight line-serpent mixed shape is also feasible. Further, the linkage protrusion may have two or more branches between its base portion bonding with the metal film and its tip portion. For example, a Y-shape or a tree shape is also feasible. For a single conductive particle, it is possible that the shapes of the plurality of linkage protrusions are the same, or there is a plurality of linkage protrusions having various shapes on the single conductive particle.

For the respective linkage protrusions, the numbers of the constituent protrusion-forming particles may be the same or different. Although a desired effect is obtained when the linkage protrusion is constituted by merely two protrusion-forming particles linked in a row, in view of further improving the conductivity, the linkage protrusion is preferably constituted by 2 to 30 (more preferably 2 to 20) protrusion-forming particles linked in a row. The number of the protrusion-forming particles constituting a linkage protrusion is measured by observing the linkage protrusion with a SEM.

It is an ideal case that all the protrusions on each conductive particle are row-like particle chains of a plurality of protrusion-forming particles. However, it is inevitable and acceptable that there are a small number of protrusions with each composed of a single protrusion-forming particle or protrusions with each composed of a plurality of massively bonded protrusion-forming particles. The effect of this invention can be sufficiently made if only two or more protrusions among arbitrarily sampled 10 protrusions on a single conductive particle are row-like particle chains of a plurality of protrusion-forming particles.

It is not entirely clear why the linkage protrusion including a row-like particle chain of a plurality of protrusion-forming particles improves conductivity, but the inventors have considered the following reasons. The aspect ratio of the linkage protrusion constituted by a row-like particle chain of a plurality of protrusion-forming particles is large. Hence, when the conductive powder of this invention is compressed for electrical connection with a conductor, the linkage protrusions with a large aspect ratio can easily penetrate the thin oxide film present on the surface of the conductor or the resin between the conductor and the conductive particles. Moreover, when the linkage protrusion is broken in the process due to the compression, the broken portion is embedded in the space between the conductor and the conductive particle to ensure the conductivity. Furthermore, when the linkage protrusion is broken, a clean metal surface without oxidation is exposed at the instant of the assembling. These may be the reasons that the conductive powder of this invention has higher conductivity.

In view of further improving the conductivity, on each conductive particle in the conductive powder, the number of the linkage protrusions depends on the particle size of the core particle, and is preferably 5 to 1000, more preferably 10 to 500 and even more preferably 20 to 300 when the mean particle size of the core particles is 1 to 30 μm, for example. The method for measuring the number of the linkage protrusions present on a single conductive particle in described in details in the following examples.

For the conductive particle of the invention, the number of the linkage protrusions present on a single conductive particle can be very large. Because a linkage protrusion includes a row-like particle chain of a plurality of protrusion-forming particles, a large number of linkage protrusions is advantageous in lowering the electrical resistance of the conductive particles. In view of this, a high density of the linkage protrusions on a single conductive particle is preferred. The density of the linkage protrusions can be expressed by the magnitude of the ratio of the total area of the exposed portions of the metal film to the projection area of the conductive particle. When the ratio (called "film exposure area ratio", hereinafter) is smaller, the density of the linkage protrusions is higher. In this invention, the film exposure area ratio of the conductive particle is preferably 60% or less, more preferably 50% or less and even more preferably 40% or less. Moreover, even when the film exposure area ratio is smaller than the preferred value, a low electrical resistance is still not expected if the protrusion is not a linkage protrusion. The method for measuring the film exposure area ratio is described in details in the examples described later.

It is preferred that each linkage protrusion on the conductive particle is formed with the metal film coated on the core particle as an integral. The linkage protrusions include the same metal or metal alloy included in the metal film. The so-called "integral" means that the metal film and all the linkage protrusions include the same material, and the linkage protrusions are formed by a single process and there is no defect, like a seam that may compromise the integrity, is present between the metal film and the linkage protrusions. When the linkage protrusions is formed with the metal film as an integral, because the strength of the linkage protrusions is ensured, the base portions of the linkage protrusions are not easily damaged even when the conductive powder is applied with a pressure. In some cases, a particle boundary is observed between a linkage protrusion and the metal film coated on the core particle when the protrusions are observed. However, such a particle boundary between the linkage protrusion and the metal film does not degrade their integrity.

With respect to the thickness of the metal film, the conductive powder is difficult to exhibit sufficient conductivity when the thickness is overly small, or the metal film easily peels off from the surface of the core particle when the thickness is overly large. In view of this, the thickness of the metal film (at the portions without protrusions) is preferably 0.01 to 0.3 μm and more preferably 0.05 to 0.2 μm. The thickness of the metal film can be derived by sequentially dissolving the metal from the conductive powder and quantifying the dissolved metal. Or, the thickness of the metal film can be obtained by embedding the conductive particle in an embedding resin, cutting out of a cross section of the conductive particle using a microtome or the like, and observing the cross section with a scanning electron microscope.

In the conductive powder of this invention, it is preferred that each particle has a spherical shape. The particle shape mentioned herein means the shape of the particle excluding all the protrusions including the linkage protrusions. When the particles are spherical, in combination with the inclusion of the linkage protrusions, the conductive powder of this invention can have high conductivity.

In the conductive powder of this invention, the size of each particle can be properly set according to the specific use of the conductive powder. Specifically, the particle size of the conductive particle is preferably 1 to 30 μm, more preferably 1 to 10 μm, further preferably 1 to 5 μm and still further preferably 1 to 3 μm. The method for measuring the particle size of the conductive particle is described in the examples described later.

The conductive particles tend to aggregate easily when the particle size thereof is small. When aggregation occurs, there is a problem that a short circuit is easily caused in the anisotropic conductive film using the conductive particles. Moreover, if a treatment such as pulverization is applied to loosen the aggregation, the metal film may peel off to cause lowering of conductivity. In view of this, for the conductive powder of this invention, increasing the dispersibility of the respective particles is important. In this invention, the weight ratio of the primary particles among the conductive particles to the conductive powder is 85 wt % or more, preferably 90 wt % or more, and more preferably 92 wt % or more. In order to increase the dispersibility of the conductive particles, the conductive particles are possibly produced with the method described later. The amount of the primary particles is measured by the following method. An amount of 0.1 g of the conductive particles is dispersed in 100 mL of water using a supersonic homogenizer for 1 min, and then the Coulter counter method is used to measure the particle size distribution, from which the weight proportion of the primary particles is calculated.

As mentioned above, the metal film and the linkage protrusions on the conductive particle include the same material. The useful materials can be the same as those usually used in the instant technical field. For example, nickel, copper, gold, silver, palladium, tin, platinum, iron, cobalt or the like can be used as the metal. The alloys of these metals can also be used. In case where nickel is used as the metal, examples of the alloy include nickel-phosphorus alloy or nickel-boron alloy. The Ni—P alloy is formed when sodium hypophosphorate is used as the nickel reductant in the production of conductive powder described later. The Ni—B alloy is formed when dimethylamine-borane or sodium borohydride is used as the nickel reductant.

In the conductive powder of this invention, the surface of each particle is made from a metal or alloy, or the surface of the metal or alloy may be coated with a noble metal. The noble metal is preferably gold or palladium as a highly conductive metal, especially gold. With the coating, it is possible to further improve the conductivity of the conductive powder. The thickness of the coating of the noble metal is about 0.001 to 0.5 μm in general. The thickness can be derived from the addition amount of the noble metal ion or chemical analyses.

Next, the suitable method for producing the conductive powder of this invention is explained with a case using nickel as the metal as an example. Even in cases using other metals, a conductive power still can be produced with the following method and the same step sequence. The production method includes two processes: 1) a process A of forming an initial nickel film on the surface of the core particle, and 2) a process B of using the particles obtained in the process A as a raw material to form the target conductive particles. The respective processes are described as follows.

In the process A, an electroless plating solution containing nickel ion and a hypophosphorate salt is mixed with core particles carrying a noble metal to form an initial nickel films on the surfaces of the core particles, The type of the core particle is not particularly limited, and an organic material or an inorganic material may be used. Considering the electroless plating described later, it is preferred that the core particles are dispersible in water. Therefore, the core particles are preferably substantially insoluble in water, and are more preferably not dissolved or modified by an acid or alkali. The possibility of dispersion in water means that by using a usual dispersion means such as stirring, a suspension caused by a substantial dispersion in water can be formed in a manner such that a nickel film can be formed on the surface of the core particles.

The shape of the core particle greatly affects the shape of the target conductive particle. Because the metal film coated on the surface of the core particle is thin, the shape of the conductive particle directly reflects the shape of the core particle. Since the shape of the conductive particle is preferably spherical as mentioned above, the shape of the core particle is preferably spherical.

When the core particle is spherical, the particle size of the core particle greatly affects the particle size of the target conductive particle. Because the nickel film coated on the surface of the core particle is thin as mentioned above, the particle size of the conductive particle almost reflects the particle size of the core particle. In view of this, the particle size of the core particle can be in the same level with the particle size of the target conductive particle. Specifically, the particle size of the core particle is preferably 1 to 30 μm, more preferably 1 to 10 μm, further preferably 1 to 5 μm and still further preferably 1 to 3 μm. The particle size of the core particle can be measured using the same method for measuring the particle size of the conductive particle.

The particle size distribution of the core material powder measured by the above method has a width. In general, the width of the particle size distribution of a powder is expressed by the coefficient of variation defined by the following Equation (1):

$$\text{Coefficient of variation (\%)}=(\text{standard deviation/mean particle size})\times 100 \quad (1).$$

A large coefficient of variation means a broad distribution, while a small coefficient of variation means a sharp distribution. In this invention, the coefficient of variation of the used core particles is preferably 30% or less, more preferably 20% or less, and even more preferably 10% or less. The reason is the merit of increasing the contribution proportion of the effective connection when the conductive particle of this invention is used in an anisotropic conductive film.

Specific examples of the core material powder include, as inorganic materials, metals (including alloys), glass, ceramics, silica, carbon, oxides of metals or non-metals (including hydrates), metal silicates including aluminum silicate, metal carbides, metal nitrides, metal carbonates, metal sulfates, metal phosphates, metal sulfides, acid salts of metals, metal halides, carbon and so on. As organic materials, the specific examples include natural fibers, natural resins, polyethylene, polypropylene, polyvinyl chloride, polystyrene, polybutene, polyamide, polyacrylate ester, polyacrylonitrile, polyacetal, ionomer, thermoplastic resins such as polyesters, alkyd resins, phenol resins, urea resins, melamine resin, benzoguanamine resin, xylene resin, silicone resins, epoxy resins and diallylphthalate resin, etc. These materials may be used alone or in combination of two or more. Particularly, in order to obtain a powder having a sharp particle size distribution, the various resins are preferably used. Moreover, a composite material (hybrid) of an organic material and an inorganic material can also be used. A powder formed from such composite material can be easily adjusted to have a desired hardness and a sharp particle size distribution, and is therefore preferably used. The examples thereof include styrene-silica composite resins and acryl-silica composite resins, etc.

Moreover, although the other physical properties of the core particles are not particularly limited, in cases where the core particles are resin particles, it is preferred that the K-value as defined by the Equation (2) below is within the range of 10 to 10000 kgf/mm$^2$ at 20° C. and the recovery ratio after 10% compression defoimation at 20° C. is within the range of 1% to 100%. When these physical property values are satisfied, the electrodes are not damaged when they are press-bonded with each other, and can have sufficient contact between them.

$$K\text{-value(kgf/mm}^2)=3\sqrt{2}\times F\times S^{-3/2}\times R^{-1/2} \quad (2)$$

The F-value and the S-value shown in Eq. (2) are the load value (kgf) and the compression deformation (mm$^2$), respectively, when the measurement is carried out by the microcompression tester MCTM-500 (made by Shimadzu Corporation), and the R-value is the radius (mm) of the microsphere.

The surface of the core particle preferably has a capability of capturing a noble metal ion, or has been surface-treated to have a capability of capturing a noble metal ion. The noble metal ion is preferably palladium ion or silver ion. Having a capability of capturing a noble metal ion means that the noble metal ion is chelated or made into a salt and thus captured. For example, when amino group, imino group, amide group, imide group, cyano group, hydroxyl group, nitrile group or carboxyl group, etc, is present on the surface of the core particle, the surface of the core particle has a capability of capturing a noble metal ion. In cases where a capability of capturing a noble metal ion is obtained by surface modification, for example, the method described in Japan Patent Publication No. Sho 61-64882 can be used.

Such a core particle is used, and a noble metal is carried on the surface thereof. Specifically, core particles are dispersed in a dilute acidic aqueous solution of a noble metal salt such as palladium chloride or silver nitrate to capture the noble metal ion on their surfaces. A concentration of the noble metal salt within the range of $1\times10^{-8}$ to $1\times10^{-2}$ mole per m$^2$ of the particle surface area is sufficient. The core particles having captured the noble metal ion are separated from the system and washed by water. Next, the core particles are suspended in water, into which a reductant is added to conduct a reduction treatment of the noble metal ion. As the reductant, for example, sodium hypophosphorate, potassium borohydride, dimethylamineborane, hydrazine or formalin, etc., can be used.

Before the noble metal ion is captured on the surface of the core particle, it is also possible to conduct a sensitization treatment in which tin ion is adsorbed on the surface of the particle. In cases where tin ion is to be adsorbed on the surface of the particle, for example, the surface-modified core particles are cast in an aqueous solution of tin(II) chloride and stirred for a predetermined period of time.

The core particles having been subjected to such a pretreatment are mixed with an electroless plating bath containing nickel ion and a hypophosphorate salt. The electroless plating bath is a solution with water as a medium. This plating bath may also contain a dispersant. Examples of the dispersant include non-ionic surfactants, zwitterionic surfactants and water-soluble polymers. As the non-ionic surfactants, polyoxyalkylene ether-type surfactants such as polyethylene glycol, polyoxyethylene alkyl ether and polyoxyethylene alkylphenyl ether can be used. As the zwitterionic surfactants, betaine-type surfactants such as alkyldimethylacetate betaine, alkyldimethylcarboxylmethylacetate betaine and alkyldimethylaminoacetate betaine can be used. As the water-soluble polymers, polyvinyl alcohol, polyvinylpyrrolidinone, hydroxyethyl cellulose and so on can be used. The amount of the dispersant being used depends on its species, and is generally 0.5 to 30 g/L based on the volume of the liquid (electroless plating bath). Particularly, when the amount of the dispersant being used is 1 to 10 g/L based on the volume of the liquid (electroless plating bath), the adhesion of the nickel film is improved.

As the nickel source of the nickel ion contained in the electroless plating bath, a water-soluble nickel salt is used. The water-soluble nickel salt may be nickel sulfate or nickel chloride, but is not limited thereto. One feature of the process is that the nickel concentration in the electroless plating bath is higher than that in conventional methods such as the method described in Patent Document 3. More specifically, the nickel concentration in the electroless plating bath is preferably 0.0085 to 0.34 mol/L and particularly preferably 0.0128 to 0.1 mol/L.

Another feature of the process A is the ratio of the hypophosphorate salt to the nickel ion contained in the electroless plating bath. Specifically, the molar ratio of the amount of the hypophosphorate salt to that of nickel ion is preferably 0.01 to 0.5 and particularly preferably 0.025 to 0.35. The amount of the hypophosphorate salt is much less than the amount theoretically required for reducing all the nickel ions contained in the electroless plating bath.

Accordingly, in the process A, the concentration of the nickel ion contained in the electroless plating bath is high, and the amount of the hypophosphorate salt for reducing the nickel ion is small. The reason of selecting such a condition is described later.

The electroless plating bath may further contain a complexing agent to make a beneficial effect of inhibiting decomposition of the plating solution. Examples of the complexing agent include organic carboxylic acids and their salts, such as citric acid, hydroxyacetic acid, tartaric acid, malic acid, lactic acid, gluconic acid and alkali metal salts and ammonium salts of the acids. These complexing agents can be used alone or in combination of two or more. The concentration of the complexing agent in the electroless plating bath is preferably 0.005 to 6 mol/L and particularly preferably 0.01 to 3 mol/L.

The method of mixing the pre-treated core particles and the electroless plating bath is not particularly limited. For example, the electroless plating bath is heated to a temperature capable of reducing nickel ions and, the pre-treated core particles are then cast into the electroless plating bath. By this operation, nickel ions are reduced, and the reduced nickel forms an initial thin film on the surface of the core particle. Because the amount of the hypophosphorate salt contained in the electroless plating bath is much less than the amount theoretically required to reduce all the nickel ions contained in the electroless plating bath, the reduction amount of nickel is small so that the initial thin film has a thickness of 0.1 to 20 nm, especially 0.1 to 10 nm. Because the reduction amount of nickel is small, linkage protrusions are not formed, and a large amount of nickel ions still remains in the solution.

As mentioned above, in the process A, the concentration of nickel ions contained in the electroless plating bath is high, and the amount of the hypophosphorate salt for reducing the nickel ion is small. Regarding this, the amounts of these components are determined based on the amount of the casted core particles. Specifically, when the concentrations of nickel ion and the hypophosphorate salt in the electroless plating bath are within the aforementioned ranges, the amount of the casted core particles based on one liter of the electroless plating bath, in terms of the total surface area thereof, is 1 to 15 $m^2$ and particularly 2 to 8 $m^2$. Thereby, an initial thin film having a predetermined thickness can be formed easily. Moreover, aggregation of the core particles formed with the initial thin film can also be prevented effectively. Aggregation of the core particles is particularly efficient when the particle size of the core particles is small, such as about 3 μm.

After the initial nickel film is formed on the surface of the core particle, a process B is conducted. The process B is conducted continuously after the process A while the pH value of the electroless plating bath is decreased to, for example, about 6, and an operation such as separating, from the liquid, the core particles having the initial nickel film obtained in the process A. Therefore, in the aqueous slurry containing the core particles having the initial nickel thin film thereon, the nickel ion added in a large amount in the process A remains in a large amount.

In the process B, the nickel ion remaining in a large amount in the aqueous slurry is reduced to form a large amount of fine nuclei in the slurry. The protrusion-forming particles and the linkage protrusions then grow based on the fine nuclei. Moreover, the nickel film also grows while the linkage protrusions grow.

In the process B, nickel ion, a hypophosphorate salt and a basic material are simultaneously and continuously added into the slurry containing the core particles having the nickel thin film obtained in the process A. The "simultaneous and continuous addition" means that the nickel ion, the hypophosphorate salt and the basic material are continuously added within a certain period of time. In such a case, it is possible that the timing of adding them is entirely the same, or that nickel ion is added first and the hypophosphorate salt and the basic material are added later (a reverse order of addition is also feasible).

The nickel source of nickel ion used in the process B can be the same as that used in the process A. This also applies to the case of the reductant.

The reduction of nickel ion in the process B has been investigated in details by the inventors. In the initial stage of the process B, a large amount of fine nuclei are formed due to the reduction of nickel ion in the solution. In next stage, protrusion-forming particles are formed on the nickel thin film on the surface of the core particle based on the nuclei, and linkage of the protrusion-forming particles is formed. In this stage, the protrusion-forming particles formed on the nickel thin film increase with time, and linkage protrusions grow due to the linkage between the protrusion-forming particles. That is, the increase of the protrusion-forming particles and the growth of the linkage protrusions occur at the same time. After more time, the number of the protrusion-forming particles no longer increases, and only the growth of the linkage protrusions proceeds due to the linkage between the protrusion-forming particles. The growth of the linkage protrusions is considered to not only occur on the nickel thin film but also occur due to the linkage between the protrusion-forming particles in the solution. In the later case, the particle chain formed due to linkage between the protrusion-forming particles is considered to be bonded with the nickel thin film.

Moreover, in the process B, while the formation and the growth of the linkage protrusions occurs simultaneously, growth of the nickel film also proceeds due to the reduction-separation of nickel on the nickel thin film on the surface of the core particle. The balance between the formation and growth of the protrusions and the growth of the nickel film can be controlled by, e.g., controlling the concentrations of nickel ion and the hypophosphorate salt as a reductant and the molar ratio of nickel and the reductant in the aforementioned process A.

In the process B, the pH in the solution gradually decreases due to the reduction of nickel ion. When the pH decreases too much, reduction of nickel ion is difficult to occur. Hence, in this process, in addition to nickel ion and the hypophosphorate salt, a basic material is also added. As the basic material, for example, hydroxides of alkali metals and ammonia can be used, wherein sodium hydroxide is preferred. The pH of the solution is preferably adjusted to 4 to 9. The addition amount of the basic material is preferably determined in a manner such that the pH of the solution is maintained in the above range.

In the process B, nickel ion and the hypophosphorate salt are preferably added in the aqueous slurry in corresponding amounts such that the separation amount of nickel in one hour is 20 to 200 nm, preferably 30 to 80 nm. Nickel ion, the hypophosphorate salt and the basic material are added simultaneously and continuously. The reason why nickel ion is further added in the process B, even though there is a large amount of nickel ion added in the process A as mentioned above, is described below. As nickel ion is reduced so that protrusion-forming particles form and the nickel film coated on the surface of the core particle grows, the nickel ion concentration in the solution will be lowered, and the nickel ion added in the process B is for supplementing nickel ion.

In the process B, as nickel ion, the hypophosphorate salt and the basic material are added in the aqueous slurry containing the core particles having the initial nickel thin film thereon, the aqueous slurry may be heated to a predetermined temperature so that the reduction of nickel ion can proceed smoothly.

Accordingly, in the production method of this invention, an initial thin film is formed on the surface of the core particle and a large amount of nickel ion remains in the solution in the process A, and then a large amount of nuclei are formed from the remaining large amount of nickel ion and protrusion-forming particles, and linkage protrusions are formed based on the nuclei in the process B. If not using this method but instead adding an amount of nickel ion just sufficient to form the initial thin film without remaining nickel ion in the process A and adding a large amount of nickel ion in the process B, whether the same effect of the instant production method is obtained or not is questionable. However, according to the result of investigation of the inventors, it is clear that the target conductive particle cannot be obtained with the latter method, for the following reason. If a large amount of nickel ion were added together with the reductant and the basic material in the process B, the reduction of nickel ion proceeds at a rush, and controlling the reduction is impossible. As a result, nickel would not be formed on the initial thin film, but would be formed into a large amount of amorphous nickel particles in the solution.

If required, the target conductive particle obtained as above can be further subjected to a post-treatment. The post-treatment is exemplified as an electroless gold plating process or an electroless palladium plating process. Through the process, a gold plating film or a palladium plating film is formed on the surface of the conductive particle. The gold plating film can be formed with a well-known electroless plating method. For example, the gold plating film can be formed by adding, into an aqueous suspension of the conductive particles, an electroless plating liquid containing tetrasodium ethylenediaminetetraacetate, disodium citrate and gold potassium cyanide and then adjusting the pH value using sodium hydroxide.

Moreover, the palladium plating film can be formed by a well-known electroless plating method, as exemplified below. A popular electroless palladium plating liquid is added in an aqueous suspension of the conductive particle, containing a water-soluble palladium compound such as palladium chloride, a reductant such as hypophosphoric acid, phosphoric acid, formic acid, acetic acid, hydrazine, boron hydride, an amine borane compound or a salt thereof, and a complexing agent. If required, a dispersant, a stabilizer and a pH buffering agent are further added. Then, the pH is adjusted using an acid such as hydrochloric acid or sulfuric acid, or a base such as sodium hydroxide, to conduct a reductive electroless plating and form a palladium plating film. Another possible method is to add, in an aqueous suspension of the conductive particles, a palladium ion source such as a tetraamminepalladium salt and a complexing agent (and a dispersant, if required) and utilize the substitution reaction of palladium ion and nickel ion to conduct a substitutive electroless plating and form a palladium plating film.

Moreover, the above palladium plating film preferably contains substantially no phosphorus or 3 wt % or less of phosphorus to obtain good conductivity and electrical reliability. In order to form such plating film, for example in a case where substitutive electroless plating or reductive electroless plating is conducted, a reductant containing no phosphorus, such as formic acid, may be used.

The dispersant used in the reductive electroless plating or substitutive electroless plating can be the same as the dispersant exemplified in the description of the process A. Moreover, as the popular electroless palladium plating liquid, for example, a product commercially available from Kojima Chemicals Co., Ltd., Japan Kanigen Co., Ltd. or Chuo Kagaku Sangyou Co., Ltd., etc., may be used.

As another post-treatment, the conductive particles can also be subjected to a pulverization process using a media mill such as a ball mill. Through the pulverization process, in combination with the aforementioned reduction condition of nickel ion, the relative weight of the primary particles to the conductive powder can be set within the aforementioned range more easily.

When the conductive particles of this invention is used as a conductive filler of a conductive adhesive as described later, the surfaces of the conductive particles can be further coated with an insulating resin to prevent short between the conductive particles. Regarding the coating of the insulating resin, the insulating coating is formed in a manner such that the surface of the conductive particle is as unexposed as possible when a pressure or the like is applied, and at least the protrusions on the surface of the conductive particle are exposed while being damaged by, for example, the heating or pressurization at a moment that two substrates are bonded using a conductive adhesive containing the conductive particle of this invention. The thickness of this insulating resin film is usually 0.1 to 0.5 μm approximately. Moreover, as long as the insulating resin film can make the effect of disposing the insulating coating, it is not necessary to entirely cover the surface of the conductive particle.

As the above insulating resin, those well known in the instant field can be used widely. Examples thereof include phenol resin, urea resin, melamine resin, allyl resin, furan resin, polyester resin, epoxy resin, silicone resin, polyamide-imide resin, polyimide resin, polyurethane resin, fluorine resin, polyolefin resins (such as polyethylene, polypropylene and polybutylene), polyalkyl(meth)acylate resin, poly(meth) acrylic acid resin, polystyrene resin, acrylonitrile-styrene-butadiene resin, vinyl resin, polyamide resin, polycarbonate resin, polyacetal resin, ionomer resin, polyethersulfone resin, polyphenyloxide resin, polysulfone resin, polyvinylidene fluoride resin, ethyl cellulose and cellulose acetate.

The method for forming an insulating coating on the surface of the conductive particle is exemplified as a chemical method such as coacervation, interface polymerization, in-situ polymerization or in-liquid curing coating, a physical mechanical method such as spray-drying, air-suspension coating, vacuum evaporation coating, dry blending, electrostatic combination, fusion distribution cooling or inorganic material capsulation, or a physical chemical method such as interface precipitation.

Such obtained conductive particles of this invention are suitably used in, for example, a conductive material for connecting the electrodes of a LCD panel to the circuit board of a driving LSI chip, such as an anisotropic conductive film (ACF) or a heat-seal connector (HSC). Particularly, the conductive particle of this invention is suitably used as a conductive filler of a conductive adhesive.

The above conductive adhesive is preferably used as an anisotropic conductive adhesive that is disposed between two substrates formed with conductive base materials and is then heated and pressurized to bond and electrically connect the conductive base materials.

The anisotropic conductive adhesive contains the conductive particle of this invention and an adhesive resin. The adhesive resin is not particularly limited, as long as it is insulating and can serve as an adhesive resin. The adhesive resin may be any of a thermoplastic resin and a thermosetting resin, and is preferably one exhibiting adhesive capability by heating. Such adhesive resins include, for example, thermoplastic types, thermosetting types, UV-curable types and so on. Moreover, semi-thermosetting types showing an intermediate property between thermoplastic types and thermosetting types, and composite types of thermosetting types and UV-curable types are also included. These adhesive resins can be properly selected in accordance with the surface property or use configuration of the circuit board or the like as the object to be bonded. Particularly, an adhesive resin composed of a thermosetting resin is preferred because of the high material strength after the adhesion.

Specifically, an example of the adhesive resin is an adhesive resin prepared using, as a major agent, one or a combination of two or more selected from ethylene-vinyl acetate copolymer, carboxyl-modified ethylene-vinyl acetate copolymer, ethylene-isobutyl acrylate copolymer, polyamide, polyimide, polyester polyvinylether, polyvinylbutyral, polyurethane, SBS block copolymer, carboxyl-modified SBS block copolymer, SIS copolymer, SEBS copolymer, maleic acid-modified SEBS copolymer, polybutadiene rubber, chloroprene rubber, carboxyl-modified chloroprene rubber, styrene-butadiene rubber, isobutylene-isoprene copolymer, acrylonitrile-butadiene rubber (called "NBR", hereinafter), carboxyl-modified NBR, amine-modified NBR, epoxy resin, epoxy ester resin, acryl resin, phenol resin, silicone resin and so on. Among the materials, as a thermoplastic resin, styrene-butadiene rubber or SEBS, etc., is preferred as having good re-work property. As a thermosetting resin, epoxy resin is preferred. Among the materials, the epoxy resin is most preferred as having merits of high adhesion, good thermal resistance and electrical insulation, low melt viscosity and possibility of low-pressure connection.

As the above epoxy resin, an ordinarily used epoxy resin can be used, as long as it is a polyvalent epoxy resin having two or more epoxy groups in one molecule. A specific example thereof is a glycidyl-type epoxy resin that is obtained by reacting, with epichlorohydrin or 2-methylepichlorohydrin, a novolac resin such as phenol novolac or cresol novolac, a polyhydric phenol species such as bisphenol A, bisphenol F, bisphenol AD, resorcin or bishydroxydiphenylether, a polyalcohol such as ethylene glycol, neopentyl glycol, glycerin, trimethylolpropane or polypropylene glycol, a polyamino compound such as ethylenediamine or triethylenetetramine, or a polycarboxy compound such as adipic acid, phthalic acid or isophthalic acid, etc.

More examples are aliphatic and alicyclic epoxy resins such as dicyclopentadiene epoxide and butadiene dimer epoxide, and so on. These resins can be used alone or in combination of two or more.

Moreover, in view of preventing ion migration, it is preferred that the above various adhesive resins are high-purity products in which less impurity (Na or Cl, etc.), hydrolyzable chlorine, or the like is contained.

In the anisotropic conductive adhesive, the usage amount of the conductive particle of this invention is usually 0.1 to 30 weight parts, preferably 0.5 to 25 weight parts and more preferably 1 to 20 weight parts, based on 100 weight parts of the adhesive resin component. By way of using the amount of the conductive particle within the above range, a rise of the connection resistance or the melt viscosity can be inhibited, the connection reliability can be improved, and the connection anisotropy can be sufficiently ensured.

In addition to the above conductive particle and adhesive resin, the anisotropic conductive adhesive can include an additive well known in the instant technical field in an amount within a range well known in the instant technical field. Examples thereof are tackifier, reactive assistant, epoxy resin curing agent, metal oxide, photoinitiator, sensitizer, curing agent, vulcanizing agent, degradation inhibitor, thermoresistance additive, thermal conduction promoter, softener, colorant, various coupling agents and metal deactivators, etc.

Examples of the tackifier include rosin, rosin derivative, terpene resin, terpene phenol resin, petroleum resin, coumarone-indene resin, styrene-type resin, isoprene-type resin, alkylphenol resin and xylene resin, etc. Examples of the reactive assistant (cross-linking agent) include polyol, isocyanate species, melamine resin, urea resin, urotropin species, amine species, acid anhydride and peroxide, etc. An epoxy resin curing agent can be used without a particular limitation if only it has two or more active hydrogens in one molecule. Specific examples thereof include: polyamino compounds, such as diethylenetriamine, triethylenetetramine, m-phenylenediamine, dicyandiamide and polyamideamine; organic acid anhydrides, such as phthalic anhydride, methyl nadic anhydride, hexahydrophthalic anhydride and pyromellitic anhydride; and novolac resins, such as phenol novolac and cresol novolac. These agents can be used alone or in combination of two or more. Moreover, according to the use or requirement, a latent curing agent may also be used. Examples of useful latent curing agents include imidazole types, hydrazide types, boron trifluoride-amine complex, sulfonium salts, amineimides, salts of polyamines, dicyanamide and so on, and their modified products. These agents can be used alone or in combination of two or more.

The above anisotropic conductive adhesive is usually produced as follows. A production apparatus widely used by people skilled in the art is used. The conductive particle of this invention, an adhesive resin and, if required, a curing agent or various additives are combined, and are mixed in an organic solvent when the adhesive resin is a thermosetting resin or are melt-blended at a temperature above the softening point of the adhesive resin, which is specifically preferably 50 to 130° C. and more preferably 60 to 110° C., when the adhesive resin is a thermoplastic resin. Such obtained anisotropic conductive adhesive can be applied through coating or in the form of a film.

EXAMPLES

This invention will be further explained with the examples, which are however not intended to limit the scope of this invention.

Examples 1-5 and Comparative Examples 1-5

(1) Process A

A spherical styrene-silica composite resin with a particle size of 3.0 μm and a true specific gravity of 1.1 (trade name: Soliostar, produced by Nippon Shokubai Co., Ltd.) was used as the core particle. The resin in the amount of 30 g was casted in 400 mL of an aqueous conditioner solution ("Cleaner Conditioner 231" produced by Dow Chemical Company) under stirring. The concentration of the aqueous conditioner solution was 40 ml/L. Next, the solution was stirred for 30 minutes under a supersonic wave at a liquid temperature of 60° C. to conduct a surface modification and a dispersion treatment of the core particles. The aqueous solution was filtered, and the core particles having been repulp water-cleaned once became a slurry of 200 mL. A 200 mL aqueous solution of tin(II) chloride in a concentration of 1.5 g/L was poured into the slurry. The mixture was stirred for 5 minutes at a normal temperature to conduct a sensitization treatment in which tin ion was adsorbed on the surface of the core particle. Next, the aqueous solution was filtered, and repulp water-cleaning was performed once. Next, the core particles were made into a slurry of 400 ml and maintained at 60° C. The slurry was then added with a 2 mL aqueous solution of palladium chloride while being stirred under a supersonic wave. The mixture was maintained stirring for 5 minutes to conduct an activation treatment in which palladium ion was captured on the surface of the core particle. Next, the aqueous solution was filtered, and repulp water-cleaning was conducted once.

Next, an electroless plating bath of 3 L, which was composed of an aqueous solution dissolved with sodium tartrate in a concentration of 20 g/L and nickel sulfate and sodium hypophosphorate in the concentrations shown in Table 1, was heated to 60° C. Then, 10 g of the palladium-carrying core particles was casted in the electroless plating bath to start the process A. After 5 minutes of stirring, the hydrogen bubbling was confirmed to stop, and the process A is completed.

(2) Process B

An aqueous solution of nickel sulfate of 200 g/L and a mixed aqueous solution containing 200 g/L of sodium hypophosphorate and 90 g/L sodium hydroxide, each of which was used in an amount of 400 mL, were continuously and respectively added, with a quantitative pump, into the core particle slurry obtained in the process A to start the electroless plating process B. The addition rate of each solution is 3 mL/min. After all the solutions were added, the mixture was continuously stirred for 5 min while being maintained at 60° C. Next, the solution was filtered, and then the filtrate was washed three times and dried in a vacuum dryer at 100° C. to obtain conductive particles having a nickel-phosphorus alloy film. Moreover, Comparative Example 1 corresponded to the technique described in Patent Document 1 described in the Background section, and Comparative Example 5 corresponded to the technique described in Patent Document 4.

Figure 2:
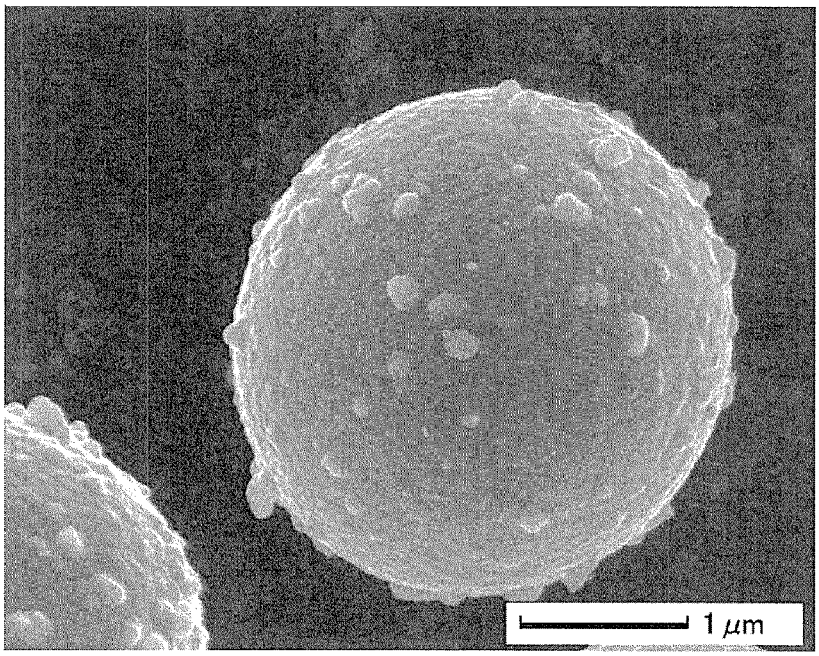
FIG. 2 is a SEM image of a conductive particle obtained in Comparative Example 1.

FIGS. 1 and 2 show the SEM images of the conductive particles obtained in Example 1 and Comparative Example 1, respectively. The conductive particle obtained in Example 1 was identified to have a plurality of linkage protrusions each of which includes fine particles linked in a row, as clearly shown in FIG. 1. Moreover, it was identified that the linkage protrusions and the film formed an integral. On the other hand, as clearly shown in FIG. 2, though protrusions were formed on the conductive particle obtained in Comparative Example 1, each of the protrusions was composed of a single particle. Moreover, in any of Examples 1 to 5, the weight ratio of the primary particles among the conductive particles was above 85 wt %.

Example 6

An electroless gold plating liquid was prepared, containing 10 g/L of EDTA-4Na, 10 g/L of disodium citrate and 2.9 g/L of gold potassium cyanide (2.0 g/L of Au). Two liters of the gold plating liquid was heated to 79° C., and was added with 10 g of the conductive particle obtained in Example 1 while being stirred. An electroless plating treatment was thus conducted to the surface of the particle for 20 minutes. After the treatment was completed, the solution was filtered, and the filtrate was repulp water-cleaned three times and then dried in a vacuum dryer at 110° C. Thereby, a gold plating coating treatment was performed on the nickel-phosphorus alloy film.

Example 7

An electroless pure palladium plating liquid was prepared, containing 10 g/L of ethylenediamine, 10 g/L of sodium formate, 20 g/L solution of tetraamminepalladium chloride ($Pd(NH_3)Cl_2$) (2 g/L of palladium) and 100 ppm of carboxymethyl cellulose (molecular weight: 250000; etherification degree: 0.9). Then, 1.3 L of the palladium plating liquid was heated to 70° C., and 10 g of the nickel-coated particle obtained in Example 1 was added under stirring. An electroless plating treatment was then conducted to the surface of the particle for 30 minutes. After the treatment was completed, the solution was filtered, and the filtrate was repulp water-cleaned three times and then dried in a vacuum dryer at 110° C. Thereby, a palladium plating coating treatment was performed on the nickel-phosphorus alloy film.

[Evaluation of Physical Properties]

Figure 3A:
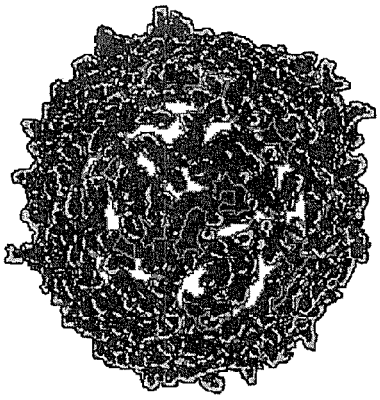
FIGS. 3(*a*) and 3(*b*) are images showing the results of the image processing steps conducted in Example 1 and Comparative Example 1, respectively, for calculating the film exposure area ratio.
Figure 3B:
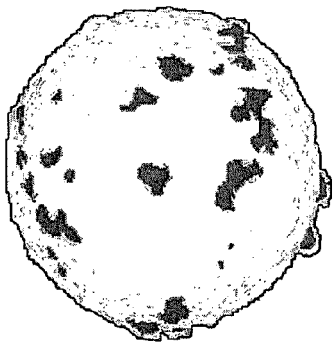

For the conductive particles in the Examples and Comparative Examples, the mean particle size of conductive particles, the nickel film thickness, the gold or palladium film thickness, the number of protrusions, the film exposure area ratio, the mean particle size of protrusion-forming particles, the ratio of protrusions and the conductivity were measured, respectively. However, the film exposure area ratio was measured only in Examples 1 and 4 and Comparative Examples 1 and 5. The results are shown in Table 2. Moreover, the results of the image processing steps conducted in Example 1 and Comparative Example 1, respectively, for calculating the film exposure area ratio are shown in FIGS. 3(*a*) and 3(*b*). The evaluations of the respective physical properties were conducted using the following methods.

[Mean Particle Size of Conductive Particles]

The value was measured using a Coulter Counter (Multisize-III) manufactured by Beckman Coulter, Inc.

[Thickness of Nickel Film]

The conductive particles were dipped in aqua regia to dissolve the nickel film, the film component was analyzed by ICP or a chemical method, and the thickness of the nickel film was calculated using the following Equations (1) and (2).

$$A=[(r+t)^3-r^3]d_1/r^3d_2 \quad (1)$$

$$A=W/(100-W) \quad (2)$$

In the equations, r is the radius (μm) of the core particle, t is the thickness of the nickel film, $d_1$ is the specific gravity of the nickel film, $d_2$ is the specific gravity of the core particle, and W is the nickel content (wt %).

[Thickness of Gold or Palladium Film]

The conductive particles were dipped in aqua regia to dissolve the gold or palladium film and the nickel film, the film components were analyzed by ICP or a chemical method, and the thickness of the gold or palladium film was calculated using the following Equations (3) and (4).

$$B=[(r+t+u)^3-(r+t)^3]d_3/(r+t)^3d_4 \quad (3)$$

$$B=X/(100-X) \quad (4)$$

In the equations, u is the thickness of the gold or palladium film, $d_3$ is the specific gravity of the gold or palladium film, $d_4$ is the specific gravity of the nickel-plated particle, and X is the content (wt %) of gold or palladium. Moreover, the specific gravity of the nickel-plated particle is calculated using the following Equation (5).

$$d_4=100/[(W/d_1)+(100-W)/d_2] \quad (5)$$

[Number of Linkage Protrusions]

A scanning electron microscope (SEM) was used to observe the conductive particles in a magnification ratio of 25000 in 10 visual fields. In reference of the Japan Patent Publication No. 2010-118334 gazette, the mean value of the existence numbers of the linkage protrusions on the surface of one conductive particle was calculated, wherein each linkage protrusion includes two or more small particles linked in a row.

[Film Exposure Area Ratio]

A conductive particle was observed in a magnified view by a SEM, and its projection area is calculated through image processing. Moreover, based on the SEM image of the conductive particle, the portions at which the metal or alloy film was exposed were identified visually and encircled by hand. The area of a portion encircled by hand was calculated through image process, and the sum of the areas of the portions was obtained. The sum was divided by the projection area of the conductive particle calculated above, and was then multiplied by 100 to calculate the film exposure area ratio.

[Mean Particle Size of Protrusion-Forming Particles]

A SEM image of a conductive particle was recorded, and arbitrary 5 linkage protrusions were selected. Arbitrary one of the protrusion-forming particles constituting the selected linkage protrusions was selected, and the size thereof was surveyed. Such operation was conducted to ten conductive particles, and the mean value of totally 50 surveyed values was calculated as the mean size of the protrusion-forming particles.

[Ratio of Linkage protrusions]

A SEM image of the conductive particles was recorded, and arbitrary 10 conductive particles were selected. For each conductive particle, arbitrary ten of the protrusions present thereon were selected, the number Xi of the linkage protrusions among the protrusions was counted, and the ratio (Xi/10) of linkage protrusions on the conductive particle was calculated. The ratio was averaged over the selected ten conductive particles [(Σ(Xi/10))/10] to obtain the ratio of linkage protrusions.

[Conductivity]

An insulating adhesive was prepared by blending, with a planetary stirring machine, 100 weight parts of an epoxy major agent JER828 (produced by Mitsubishi Chemical Corporation), 30 weight parts of curing agent Amicure PN23J (produced by Ajinomoto Fine-Techno Co., Inc.) and 2 weight parts of a viscosity adjuster, and was combined with 15 weight parts of the conductive particles to obtain a paste. A bar coater was used to coat the paste on a silicone-treated polyester film and dried. The obtained coated film was used to make a connection between a glass fully evaporation-deposited with aluminum and a polyimide film substrate formed with copper patterns having a pitch of 50 μm. The connection resistance between the electrodes was then measured to evaluate the conductivity of the conductive particles.

TABLE 1

| | | $NiSO_4$ (g/L) | $NaH_2PO_2$ (g/L) | $NaH_2PO_2/NiSO_4$ (molar ratio) |
|---|---|---|---|---|
| Example | 1 | 10.00 | 0.50 | 0.124 |
| | 2 | 23.00 | 1.55 | 0.167 |
| | 3 | 55.00 | 2.20 | 0.099 |
| | 4 | 2.35 | 0.40 | 0.422 |
| | 5 | 15.00 | 2.80 | 0.463 |
| Comparative Example | 1 | 2.10 | 2.30 | 2.716 |
| | 2 | 95.00 | 2.30 | 0.060 |
| | 3 | 10.00 | 0.03 | 0.007 |
| | 4 | 10.00 | 2.50 | 0.62 |
| | 5 | 0.45 | 5.40 | 23.640 |

TABLE 2

| | | Mean particle size (μm) of the conductive particles | Plating thickness (nm) Ni | Au | Pd | Number of linkage protrusions | Film exposure area ratio (%) | Mean particle size (nm) of protrusion-forming particles | Ratio (%) of linkage protrusions | Conductivity (Ω) |
|---|---|---|---|---|---|---|---|---|---|---|
| Example | 1 | 3.2 | 101 | — | — | 108 | 7.8 | 151 | 49 | 1.0 |
| | 3 | 3.2 | 103 | — | — | 80 | — | 176 | 41 | 1.5 |
| | 3 | 3.4 | 105 | — | — | 64 | — | 190 | 36 | 1.3 |
| | 4 | 3.2 | 100 | — | — | 51 | 42.7 | 147 | 35 | 1.1 |
| | 5 | 3.3 | 103 | — | — | 38 | — | 179 | 32 | 1.6 |
| | 6 | 3.3 | 90 | 25 | — | 103 | — | 153 | 48 | 0.6 |
| | 7 | 3.3 | 100 | — | 25 | 92 | — | 174 | 45 | 0.8 |
| Comparative Example | 1 | 3.2 | 100 | — | — | 0 | 88.6 | — | — | 2.5 |
| | 2 | 5.5 | 110 | — | — | 0 | — | — | — | 3.3 |
| | 3* | — | — | — | — | — | — | — | — | — |
| | 4 | 5.3 | 102 | — | — | 0 | — | — | — | 2.1 |
| | 5 | 3.2 | 93 | — | — | 0 | 77.2 | — | — | 1.8 |

*In Comparative Example 3, nickel was separated abnormally so that no product was supplied.

It is clear from the result shown in Table 2 that the conductive powders obtained in Examples 1 to 7 as products of this invention had higher conductivity than the conductive powders obtained in Comparative Examples 1 to 5.

[Industrial Utility]

The conductive powder of this invention has an even higher conductivity than conventional conductive powders because a plurality of protrusions on the conductive particles constituting the powder are each composed of a particle chain of a plurality of particles linked in a row.

What is claimed is:

1. A conductive powder, comprising:

conductive particles, each of the conductive particles comprising a core particle and a film of a metal or an alloy formed on a surface of the core particle and having a plurality of protrusions protruding from a surface of the film, wherein each protrusion comprises a particle chain comprising a plurality of particles of the metal or the alloy linked in a row.

2. The conductive powder of claim 1, wherein the metal or the alloy is nickel or a nickel alloy.

3. The conductive powder of claim 1, wherein a ratio of a total area of exposed portions of the film of the each of the conductive particles relative to a projection area of the each of the conductive particles is 60% or less.

4. The conductive powder of claim 1, wherein a weight of primary particles among the conductive particles takes up 85 wt % or more of a weight of the conductive powder.

5. The conductive powder of claim 1, wherein a mean particle size of the core particles ranges from 1 μm to 30 μm.

6. The conductive powder of claim 1, wherein a surface of the film including the protrusions is coated with gold or palladium.

7. A conductive material, comprising the conductive powder of claim 1 and an insulating resin.

8. A method of producing a conductive powder, comprising:

a process A of mixing an electroless plating solution containing nickel ions and a hypophosphorate salt with core particles carrying a noble metal to prepare a slurry containing the core particles with an initial nickel thin film formed on their surfaces, wherein a concentration of the nickel ions is adjusted to 0.0085 to 0.34 mole/L, an amount of the hypophosphorate salt is adjusted such that its molar ratio to an amount of the nickel ions ranges from 0.01 to 0.5, and the core particles are used in an amount such that a total area thereof based on one liter of the electroless plating solution ranges from 1 $m^2$ to 15 $m^2$; and a process B of simultaneously and continuously adding the nickel ions, the hypophosphorate salt and a basic material to the slurry prepared in the process A, so that the nickel ions are reduced to form nickel fine-particles in the slurry, and a plurality of protrusions, each of which comprises a particle chain comprising a plurality of the nickel fine-particles linked in a row, is formed on a surface of the initial nickel film on the core particles.

* * * * *